US011373629B2

(12) United States Patent
McFarland

(10) Patent No.: US 11,373,629 B2
(45) Date of Patent: Jun. 28, 2022

(54) SPECIAL EUPHONIUM EXTENSION REST DEVICE

(71) Applicant: Bruce E McFarland, Yorktown, IN (US)

(72) Inventor: Bruce E McFarland, Yorktown, IN (US)

( * ) Notice: Subject to any disclaimer, the term of this patent is extended or adjusted under 35 U.S.C. 154(b) by 0 days.

(21) Appl. No.: 17/377,307

(22) Filed: Jul. 15, 2021

(65) Prior Publication Data

US 2022/0020346 A1 Jan. 20, 2022

Related U.S. Application Data

(60) Provisional application No. 63/052,510, filed on Jul. 16, 2020.

(51) Int. Cl.
*G10D 9/00* (2020.01)
*G10G 5/00* (2006.01)

(52) U.S. Cl.
CPC ..... *G10G 5/005* (2013.01); *G10D 9/00* (2013.01)

(58) Field of Classification Search
CPC ..... G10G 5/005; G10D 9/00; G10D 7/10
See application file for complete search history.

(56) References Cited

U.S. PATENT DOCUMENTS

| | | | | |
|---|---|---|---|---|
| 1,570,168 | A | 1/1926 | Mortensen | |
| 1,612,148 | A | 12/1926 | Oettinger | |
| 2,575,795 | A * | 11/1951 | Chenava | G10D 9/06 84/400 |
| 3,811,357 | A | 5/1974 | Stewart | |
| 4,067,527 | A | 1/1978 | Streit | |
| 4,572,050 | A | 2/1986 | Werner | |
| 5,789,687 | A | 8/1998 | Johnson | |
| 2012/0024127 | A1 * | 2/2012 | Rashleigh | G10D 7/10 84/395 |

* cited by examiner

*Primary Examiner* — Kimberly R Lockett
(74) *Attorney, Agent, or Firm* — Ritchison Law Offices, PC; John D Ritchison

(57) ABSTRACT

A Euphonium Extension Rest for a portable device to support a musical instrument such as a baritone horn, a euphonium, a small tuba, or a similar instrument with a portable stand so that a musician can handle the instrument for lengthy sessions; the device includes an extendable wrap with a left-hand and right-hand curved side rail and a bottom half of a hemisphere, a protection cushion contiguous to the curved side rails, a way to secure the protection cushion to each of the left-hand and right-hand curved side rails, and a securing manner to releasably encircle the musical instrument to hold the extendable wrap.

20 Claims, 8 Drawing Sheets

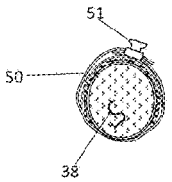
Fig. 4 C-1
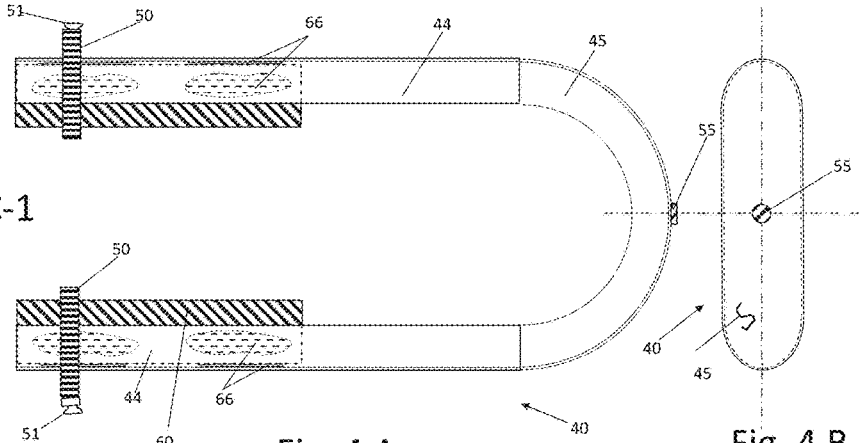
Fig. 4 A
Fig. 4 B
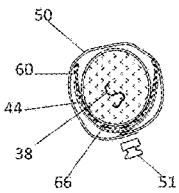
Fig. 4 C-2
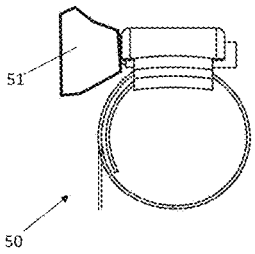
Fig. 4 D
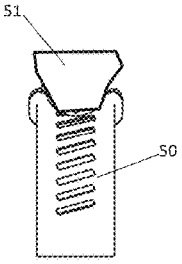
Fig. 4 E
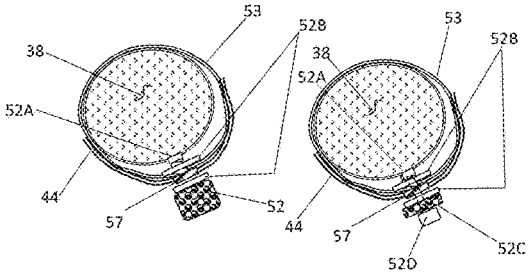
Fig. 4 F
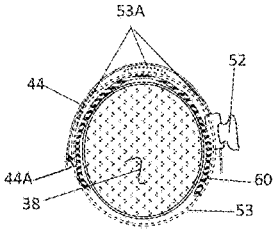
Fig. 4 G-1
Expanded End View
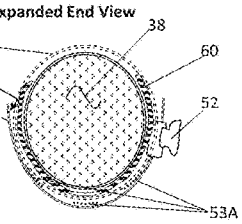
Fig. 4 G-2
Expanded End View
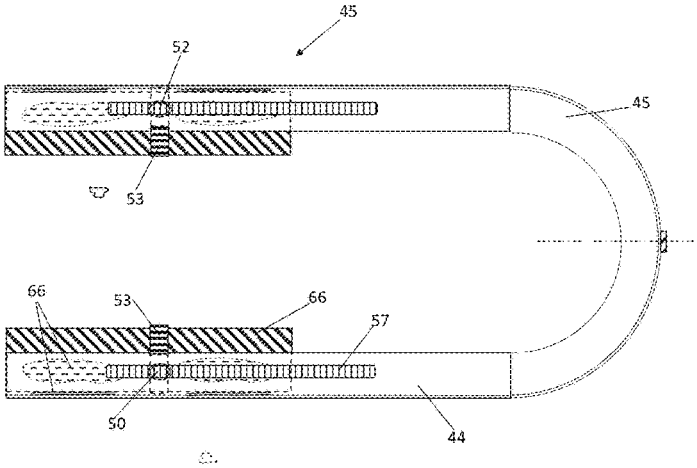
Fig.4 H
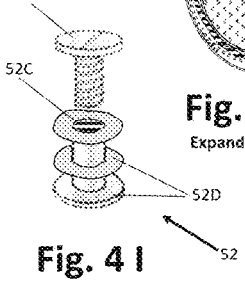
Fig. 4 I Euphonium Baritone Horn

200

WO 02/05259
Stabilizer for small brass instrument
Shulman - 2002

201

US 7,473,83
Trombone Stand
Holtfreter- 2009

202

US 3,811,357
Musical Instrument Support
Stewart - 1974

203

US 4,572,050
No Strap Saxophone Stand
Werner - 1986

204

US 6,220,459
Saxophone Stand
Runyon - 2001

205

US 5,789,687
Musical Instrument Support
Johnson - 1998

SPECIAL EUPHONIUM EXTENSION REST DEVICE

CROSS-REFERENCE TO RELATED APPLICATIONS

This application claims the benefit of U.S. Provisional Patent Application with Ser. No. 63/052,510 filed Jul. 16, 2020, by Dr. Bruce E. McFarland. The application is entitled "Special Euphonium Extension Rest Device".

FIELD OF INVENTION

The present development is a Special Euphonium Extension Rest Device. This invention relates to a Special Euphonium Extension Rest Device for supporting a musical instrument. The device or system relates to a stand or rack for holding and supporting musical instruments. This device relates to a support improvement in horn stands and more particularly to a portable stand for a baritone horn, a euphonium, a small tuba, or a similar instrument which would be difficult for a musician to handle for lengthy sessions. The present invention relates to the field of musical instrument stands, and to musical instrument stands having retracting rest or support that cradle or extends from the musical instrument.

FEDERALLY SPONSORED RESEARCH

None.

SEQUENCE LISTING OR PROGRAM

None.

BACKGROUND—FIELD OF INVENTION and PRIOR ART

As far as known, there are no Special Euphonium Extension Rest devices or the like. It is believed that this product is unique in its design and technologies.

BACKGROUND

This background as to Special Euphonium Extension Rest Devices should be useful. Supports for musical instruments are known in the art. However, some of the prior devices mount the musical instruments to the musician. In such devices, such as neck straps, the instruments still may bear on the body of the musician. This may cause an unnatural force to be placed on the musician's body, thus possibly affecting breath control. In certain other prior support devices, specifically with respect to bassoons, seat straps are utilized to mount the instrument to the seat. However, the bassoon extends below the player's chair, making use of a strap at the bottom possible.

It is well known by musicians of the discomfort of the strap around the neck to support the instrument playing on the job or sustained during private practice. Numerous inventions have attempted to provide a means to support the heavy weight of the music instrument, especially horns. However, these inventions limited either the portability of the instrument in that it is not easily detached from the stand or in that the instrument is not supported while playing. Some typical supports are not free to be detached easily from the stand. Others provide for several complicated features that fail to solve the problem in an efficient and economical way. None of these patents suggest the novel features of the present invention.

Other prior devices provide support stands mounted to a chair in which the musician sits. However, such stands are inherently part of the seat and not portable. This restricts the musician to the utilization of a seat when playing the instrument, thus causing some general inconvenience. Some prior support devices include adjustable instrument supports. However, such devices bear against the floor and not on a seat upon which the musician is sitting. The extended length of such support stands provides added structural insecurity as well as not permitting accurate positioning of the instrument with respect to the musician's body. Furthermore, such instruments suitable for use with floor-supported stands are those which come much closer to the floor through their normal construction, as base clarinets, cellos etc.

A concert style tuba is designed to be played with the lower end of the tuba resting on the musician's thighs, while the upper end is balanced upright by the musician's arms and hands. Many musicians can successfully balance the instrument in the proper manner upon their lap, but this can be tiring task since it is generally a constant struggle. The instrument has the tendency to slide down the musician's thigh as the instrument is being played and, therefore, it may need nearly continuous readjustment. The instrument can also be heavy and, therefore, create uncomfortable pressure on the musician's thighs.

In an effort to make playing the tuba more comfortable, many musicians will slide back in their chairs and rest the tuba on the front corner of their seat between their legs. This is especially true when the musician spends a long time playing the instrument. While this makeshift solution does relieve the pressure on the musician's lap, it results in an awkward sitting position for the musician. A chair-borne device is needed which can act as a musical instrument support for a tuba or other musical instrument. The musical instrument support should be portable and adjustable. The musical instrument support should provide the musician with the sense that the instrument is being balanced on a musician's lap, yet at the same time allow the musician to be more comfortable and to manage the instrument more easily. The musical instrument support should not compromise the acoustic characteristics of the instrument, nor should it scratch the instrument. The musical instrument support should accommodate use by a range of musicians of varying body size, as well as accommodate a variety of different musical instruments.

Problem Solved

The improvements and problems solved as to Euphonium Extension Rest Devices and other musical instrument support mechanisms are as follows: The Euphonium Extension Rest Device is a fast, secure, and precise way to quickly extend the device from the euphonium and assist the musician in supporting the instrument. By doing so, it reduces fatigue, permits the musician to focus on playing the musical piece rather than supporting the weight of the instrument. All the listed advantages and benefits come to being with the assist of the Euphonium Extension Rest Device.

PRIOR ART

As far as known, there are no Euphonium Extension Rest Devices or the like. It is believed that this product is unique in its design and technologies. A novelty search revealed:

A. U.S. Pat. No. 1,570,168 in 1926 awarded to AUGUST MORTENSEN, for a MUSICAL-INSTRUMENT SUPPORT. It supports or serves as a holding device for musical instruments of various kinds and classes and particularly to large brass instruments, as for example Sousaphones.

B. U.S. Pat. No. 1,612,148 in 1926 awarded to Mark Oettinger for a MUSICAL INSTRUMENT RACK. It relates to a stand or rack for holding musical instruments either for exhibition in a sales room, or else while the instrument, for instance a banjo, is not being used by an orchestra member whose duties involve the handling of several instruments.

C. U.S. Pat. No. 3,811,357 was issued to Stewart in 1974 for a MUSICAL INSTRUMENT SUPPORT. It is a device for supporting a musical instrument on a chair upon which a musician is sitting. The instrument supporting device includes an extended rod having channels formed therein and passing around a peripheral boundary of the rod. A first instrument grasping mechanism is mounted to the rod member and an appendage of the musical instrument. A second instrument grasping mechanism is mounted to the instrument and the rod member and threadedly engages a thumbscrew. The thumbscrew passes through a clamp of the second grasping mechanism and is insertable within a channel formed on the rod for fixedly positioning the support device with respect to the instrument.

D. U.S. Pat. No. 4,067,527 issued to Streit in 1978 was for a Musical instrument support stand with counter-balanced, vertically movable horn support rack. It is a combination support stand and support rack for a heavy and cumbersome musical instrument, such as a Sousaphone or a tuba. The rack is adjustable arcuately, vertically and laterally to hold the instrument in playing position and is especially desirable for use by children who are learning to play such instruments, but who are physically unable to handle them. Provision is made to maintain both the stand and the rack in adjusted position so it may be brought back to the same position without further adjustment, when the player leaves the instrument and then returns to resume playing. A counterbalanced parallelogram mechanism provides means by which the instrument is easily raised with a minimum of effort while the player is seated, so that the rack may be moved out of the way when the player wishes to leave the seated, playing position, and is easily returned so the rack and the instrument will be in the same adjusted position, when the player returns to the seated, playing position.

E. U.S. Pat. No. 4,572,050 issued to Werner in 1986 for a No strap saxophone stand. It is a saxophone stand for releasably supporting a musical instrument, having a base, an elongated support member mounted and balanced on the base, further having a bell rest for receiving the bell of the saxophone and a lower brace for supporting the lower portion of the saxophone, forces created by the bell rest and lower brace acting against the saxophone hold the saxophone in a balanced position in order that the instrument can be played without using a supporting strap around the player's neck. AND F. U.S. Pat. No. 5,789,687 issued to Johnson in 1998 is a Musical instrument support. It describes a chair-borne musical instrument support that is both adjustable and portable. The musical instrument support includes a seat portion having an adjustably attached support arm with an instrument rest attached to the top thereof. The musician places the seat portion of the device on the seat of a chair, and then sits on the seat portion. The support arm and instrument rest extend upward near the front edge of the chair and between the legs of the musician. The weight of the musician sitting on the chair holds the device in place. Alternatively, the musical instrument support may be held in place on a chair by adjustable straps. The base of the tuba is then placed upon the instrument rest which is covered with a non-abrasive, non-skid surface. The support arm and instrument rest may be adjusted vertically up or down to a comfortable height. The instrument then rests in the same position as if it were being held on the musician's lap, but now it does not have to be borne by the musician's legs. The musical instrument support is not permanently attached to the chair; therefore, the support may be easily removed and carried with the musician or stored for later use. Several embodiments of the present invention are contemplated which are designed to be used by different size musicians and with different types of instruments.

As can be observed, none of the prior art has anticipated or caused one skilled in the art of musical rests or supports for a euphonium or baritone horn to see this invention by McFarland as obvious to a person skilled in the ordinary art of the industry. The support device for a Euphonium provides an answer to the need musicians face when playing the euphonium for extended sessions such as a concert or extended practice. The grasping and support of the euphonium distracts the musician and prevents optimum performance with the euphonium instrument or similar horns. This invention helps to prevent fatigue and possibly other injuries as well as providing a better support for the euphonium.

SUMMARY OF THE INVENTION

This invention is a Special Euphonium Extension device for various applications. The preferred embodiment of a Special Euphonium Extension is comprised of: (a) an extendable wrap made of durable and lightweight material comprising a left-hand and right-hand curved side rail and a bottom half of a hemisphere; (b) a protection cushion contiguous to the left-hand and right-hand curved side rails; (c) a means to secure the protection cushion to each of the left-hand and right-hand curved side rails; and (d) a pair of quick release band clamps encircling a set of euphonium side tubing to the left-hand and right-hand curved side rails of the extension rest device wherein the pair of quick release clamps releasably secure the extension rest device to the side tubing of the euphonium and permit the extension rest device to slidably extend to support and slidably retract to store the device along the side tubing of the euphonium. The newly invented Special Euphonium Extension device for various applications may be manufactured at low volumes by very simple means and in high volume production by more complex and controlled systems.

Objects and Advantages

There are several objects and advantages of the Special Euphonium Extension Rest device. There are currently no other known support or rest devices that are effective at providing the objects of this invention. The various advantages and benefits are shown in Table A:

| Item | Advantages |
|---|---|
| 1 | Enables relaxation during use and play of the instrument |
| 2 | Prolongs endurance |
| 3 | Facilitates better posture and therefore breathing |
| 4 | One-time installation |
| 5 | No need to remove it every time |
| 6 | Fits in the case |
| 7 | Convenient |
| 8 | Light |
| 9 | Fast/quick to use |
| 10 | Easy to use |
| 11 | Compact |
| 12 | No impact to output sound/tone |
| 13 | Easily Compatible with baritone and other brass horns |
| 14 | Can be made from several materials |

Finally, other advantages and additional features of the present Special Euphonium Extension Rest devices will be more apparent from the accompanying drawings and from the full description of the device. For one skilled in the art of slides, extensions, instrument supports and other means for assisting the handling of musical devices, it is readily understood that the features shown in the examples with this product are readily adapted to other types of musical instrument systems and devices.

DESCRIPTION OF THE DRAWINGS—FIGURES

The accompanying drawings, which are incorporated in and constitute a part of this specification, illustrate an embodiment of the Special Euphonium Extension Rest Devices for various applications device that is preferred. The drawings together with the summary description given above and a detailed description given below explain the principles of the support and rest device. It is understood, however, that the Special Euphonium Extension Rest Device is not limited to only the precise arrangements and instrumentalities shown.

FIGS. 4A through 4I are sketches of the special euphonium extension rest device with features and components identified.

DESCRIPTION OF THE DRAWINGS—REFERENCE NUMERALS

Figure 1A:
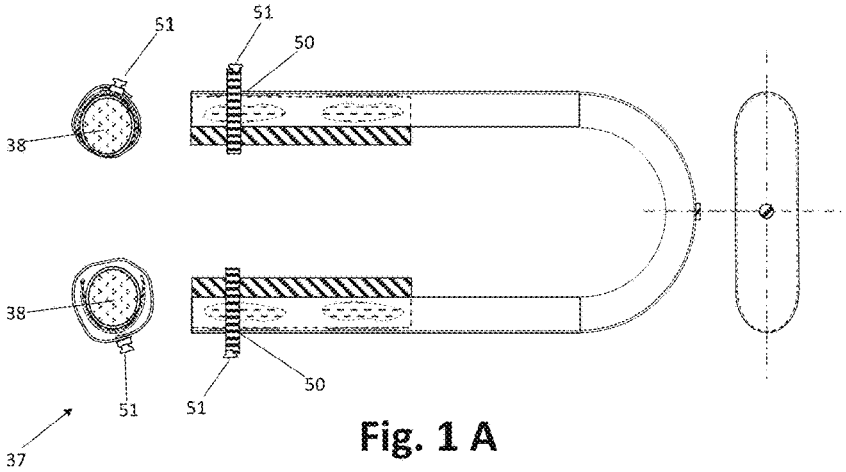
FIGS. 1A through 1C are sketches of the general euphonium extension rest device for euphonium and baritone instruments applications.

The following list refers to the drawings:

TABLE B

Reference numbers.

| Ref # | Description |
|---|---|
| 30 | Special euphonium extension rest device 30 |
| 35 | Prototype 35 of Special euphonium extension rest device 30 |
| 37 | Design sketch 37 of Special euphonium extension rest device 30 |
| 38 | Euphonium instrument 38 |
| 39 | Baritone horn 39 |
| 40 | Extendable wrap 40 made of durable and lightweight metal, aluminum, cast zinc, brass, molded plastics- reinforced and non-reinforced, and composite materials |
| 44 | Left- and right-side rails 44 of the wrap 40 |
| 44A | inside surface of each of the Left- and right-side rails 44 of the wrap 40 |
| 45 | Bottom half of a hemisphere 45 of wrap 40 |
| 50 | Quick release band clamp 50 (like or like a radiator clamp) |
| 51 | Threaded wing operator 51 on clamp 50 |
| 52 | quick release double headed threaded locking fastener 52 |
| 52A | Non-marring, friction tip 52A of quick release double headed threaded locking fastener 52 |
| 52B | Flanges 52B on boss 52C to slidably contain wrap side 44 aperture 57 |
| 52C | Threaded boss 52C for fastener 52D |
| 52D | fastener 52D |
| 53 | Optional internal band 53 at horn band 54 with quick release double headed threaded locking fastener 52 |
| 53A | means 53A to connect internal band 53 to inside surface of wraps 44A such as adhesive, epoxy, integral molding plastics, heat welds, ultrasonic welds, brazes, metal welds, etc. |
| 54 | horn band 54 integral to horn design and build |
| 55 | Optional external pad 55 rest |
| 57 | aperture/slot 57 in extendable wrap 40 that allows quick release double headed threaded locking fastener 52 to releasably secure wrap 40 to Euphonium instrument 38 or Baritone horn 39 |
| 60 | Protection cushion 60 made of foam, felt, fabric, plastic, natural or synthetic rubber or the like |
| 66 | a means to secure 66 such as adhesive tape, glue, contact cement, heat fusion/seal or the like securing protection cushion 60 to wrap 40 |
| 70 | Musician 70 |
| 200 | Prior Art 200 World Patent - WO 02/05259 - Stabilizer for small brass instrument - Shulman - 2002 |
| 201 | Prior Art 201 - US Patent 7,473,83 - Trombone Stand - Holtfreter- 2009 |
| 202 | Prior Art 202 - US Patent 3,811,357 - Musical Instrument Support - Stewart - 1974 |
| 203 | Prior Art 203 - US Patent 4,572,050 - No Strap Saxophone Stand - Werner - 1986 |
| 204 | Prior Art 204 - US Patent 6,220,459 - Saxophone Stand - Runyon - 2001 |
| 205 | Prior Art 205 - US Patent 5,789,687- Musical Instrument Support - Johnson - 1998 |

DETAILED DESCRIPTION OF PREFERRED EMBODIMENT

The present development is a Special Euphonium Extension Rest Device. This invention relates to a Special Euphonium Extension Rest Device for supporting a musical instrument. The device or system relates to a stand or rack for holding and supporting musical instruments. This device relates to a support improvement in horn stands and more particularly to a portable stand for a baritone horn, a euphonium, a small tuba, or a similar instrument which would be difficult for a musician to handle for lengthy sessions. The present invention relates to the field of musical instrument stands, and to musical instrument stands having retracting rest or support that cradle or extends from the musical instrument.

The advantages for the Special Euphonium Extension Rest Device 30 are listed above in the introduction. Succinctly the benefits are that the device:

A. Enables relaxation during use and play of the instrument;
B. Prolongs endurance;
C. Facilitates better posture and therefore breathing;
D. One-time installation;
E. No need to remove it every time;
F. Fits in the case;
G. Convenient;
H. Light;
I. Fast/quick to use;
J. Easy to use;
K. Compact;
L. No impact to output sound/tone;
M. Easily Compatible with baritone and other brass horns; and
N. Can be made from several materials;

The preferred embodiment of a Special Euphonium Extension device 30 is comprised of: (a) an extendable wrap 40 made of durable and lightweight material comprising a left-hand and right-hand curved side rails 44 and a bottom half of a hemisphere 45; (b) a protection cushion 60 contiguous to the left-hand and right-hand curved side rails; (c) a means to secure 66 the protection cushion 60 to each of the left-hand and right-hand curved side rails; and (d) a pair of quick release band clamps 50 encircling a set of euphonium 38 side tubing to the left-hand and right-hand curved side rails 44 of the extension rest device wherein the pair of quick release clamps 50 releasably secure the extension rest device to the side tubing of the euphonium and permit the extension rest bottom 45 and optional pad rest 55 device to slidably extend to support and slidably retract to store the device along the side tubing of the euphonium.

There is shown in FIGS. 1 through 8 a complete description and operative embodiment of the Special Euphonium Extension Rest Device. In the drawings and illustrations, one notes well that the FIGS. 1-8 demonstrate the general configuration and use of this product. The various example uses are in the operation and use section, below.

The accompanying drawings, which are incorporated in and constitute a part of this specification, illustrate an embodiment of the Special Euphonium Extension Rest Device 30 that is preferred. The drawings together with the summary description given above and a detailed description given below explain the principles of the special rest device 30. It is understood, however, that the Special Euphonium Extension Rest Device 30 is not limited to only the precise arrangements and instrumentalities shown. Other examples of rests and support devices for other types of musical instruments and the like are still understood by one skilled in the art of musical instruments and related mechanisms to be within the scope and spirit shown here.

Figure 1B:
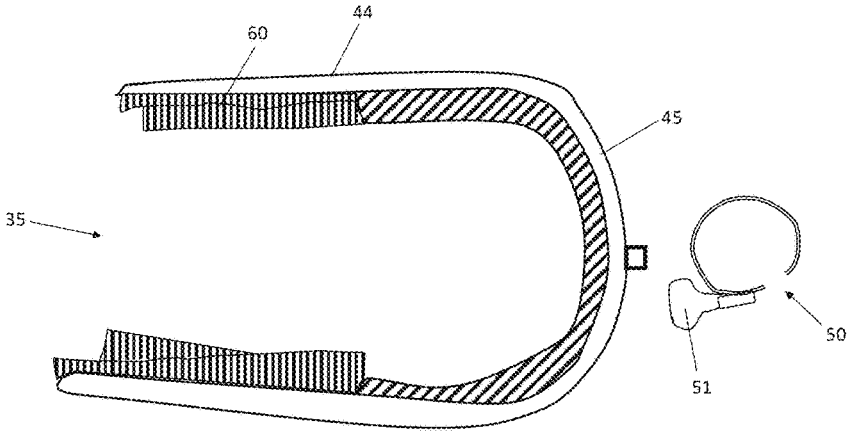
Figure 1C:
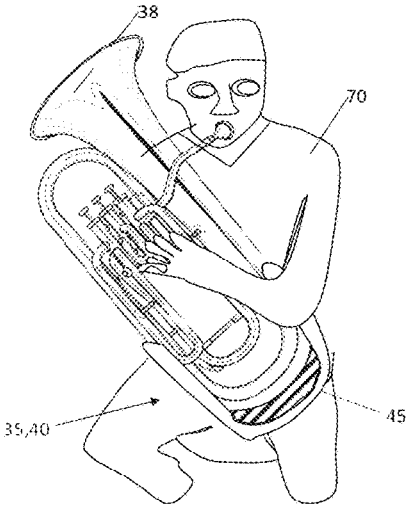
Figure 2A:
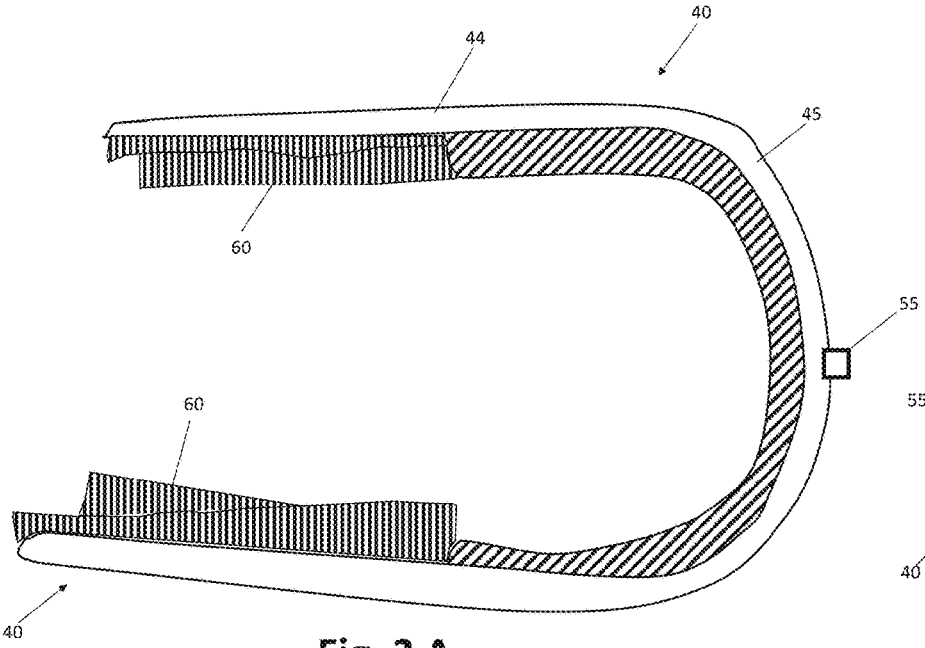
FIGS. 2A through 2E are sketches of the prototype of a special euphonium extension rest device with components and features noted.
Figure 2C:
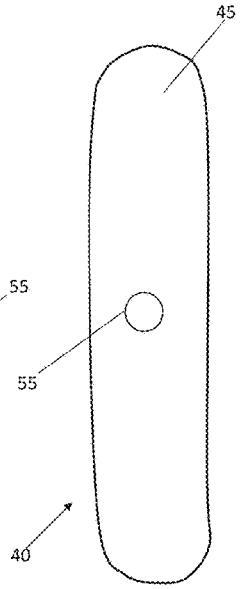
Figure 2B:
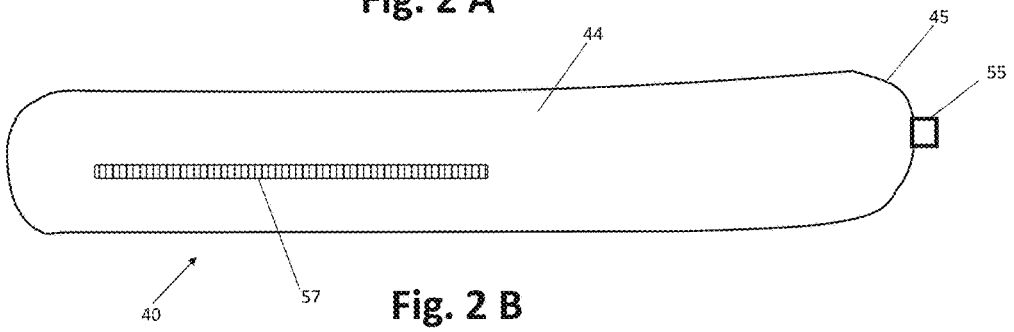
Figure 2D:
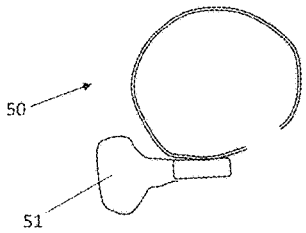
Figure 2E:
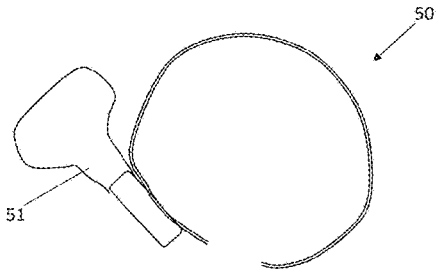
Figure 3B:
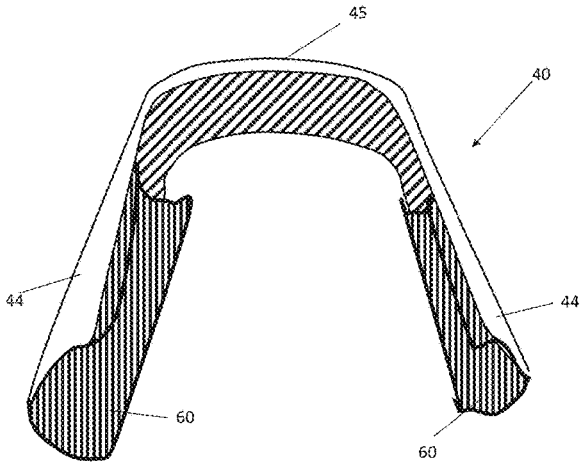
FIGS. 3A through 3D are more sketches of the protype device with the components and features shown from generally a top view.
Figure 3C:
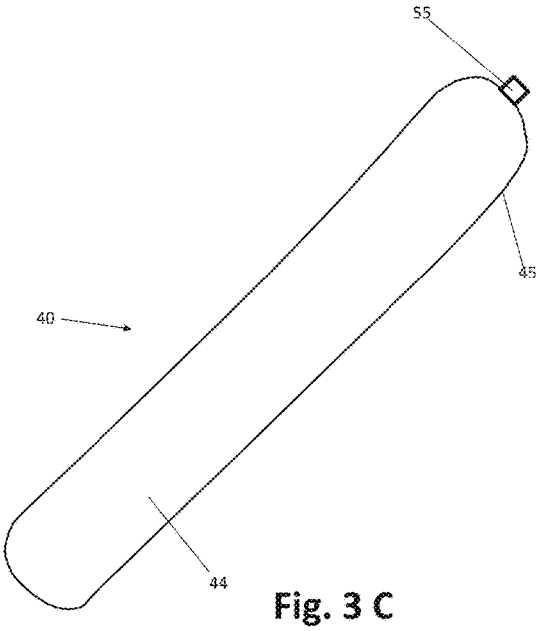
Figure 3A:
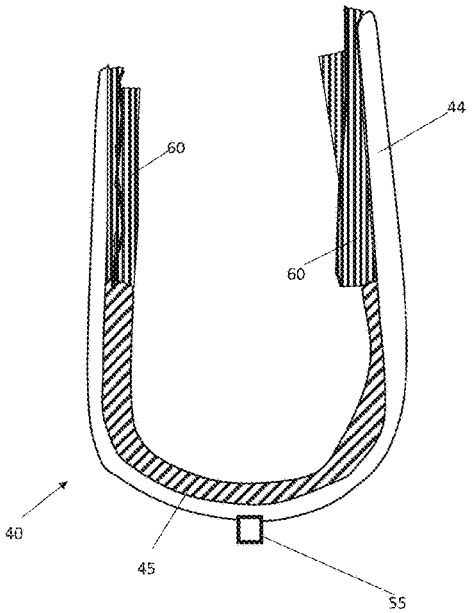
Figure 3D:
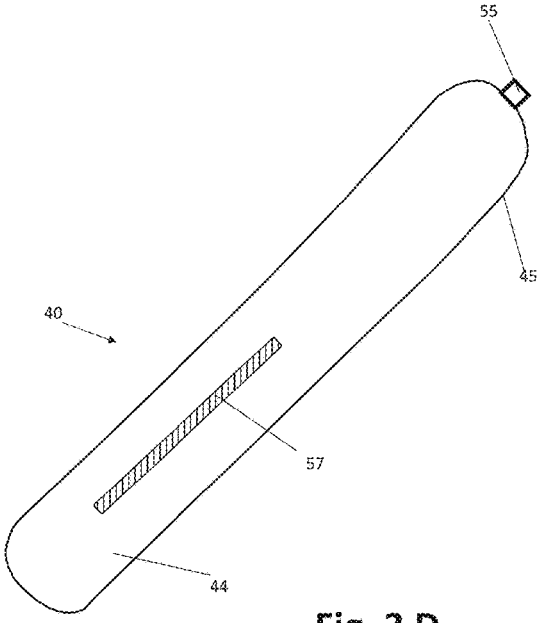
Figure 5A:
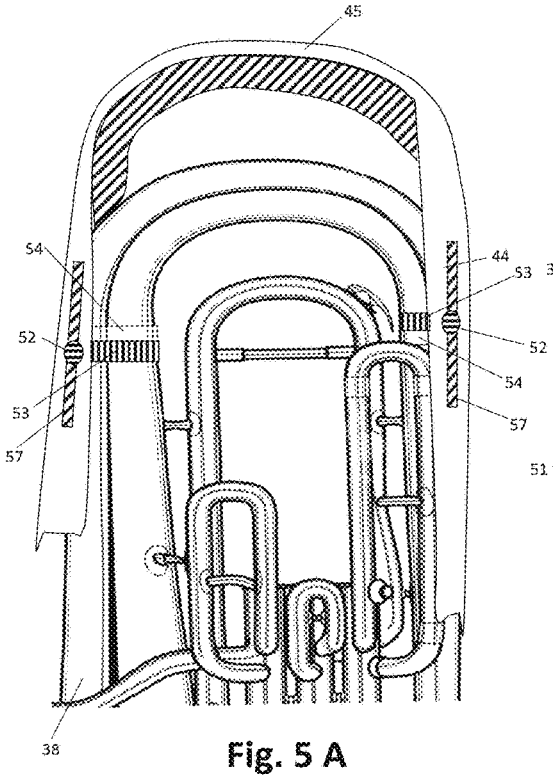
FIGS. 5A through 5D are sketches of the prototype device with components shown attached to a euphonium.
Figure 5B:
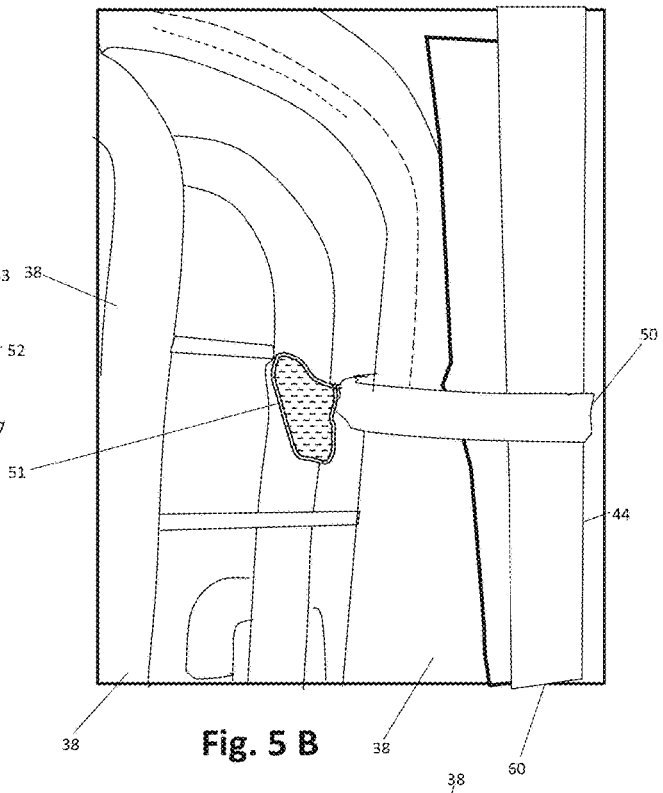
Figure 5C:
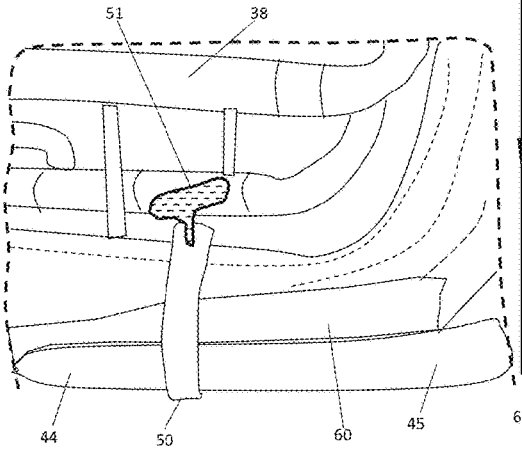
Figure 5D:
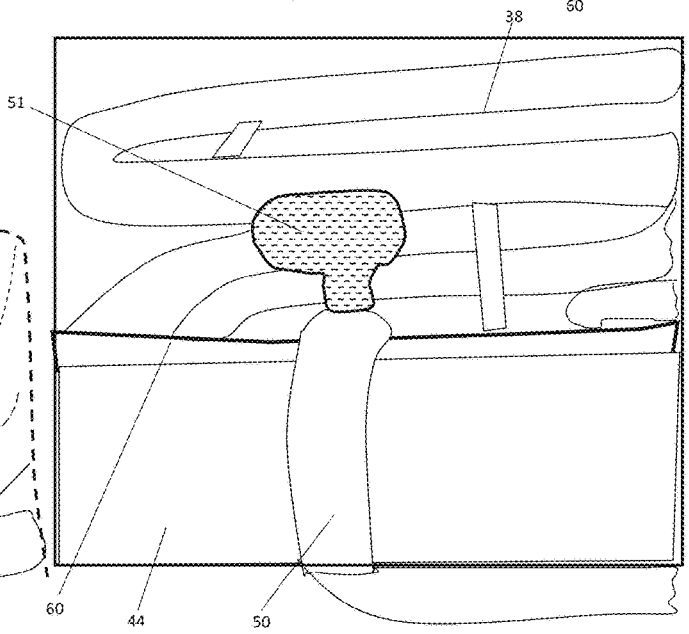
Figure 6A:
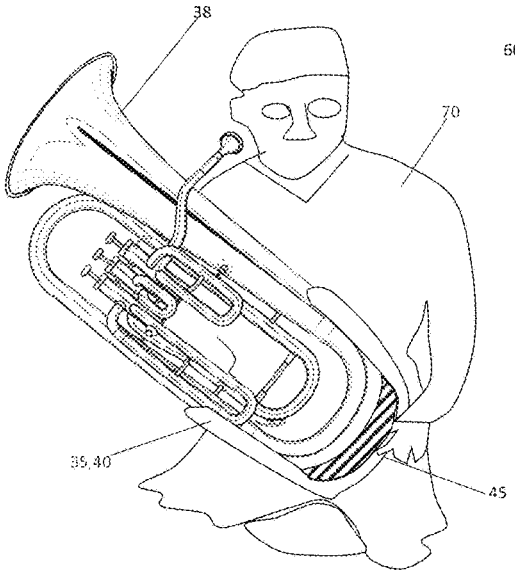
FIGS. 6A through 6E are sketches of a musician using the special extension device to support a euphonium while being played at a performance.
Figure 6B:
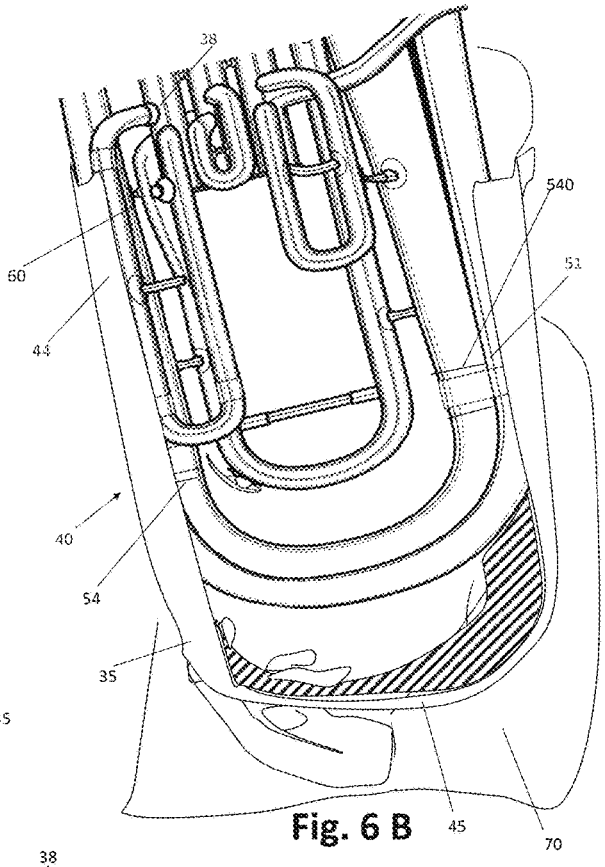
Figure 6C:
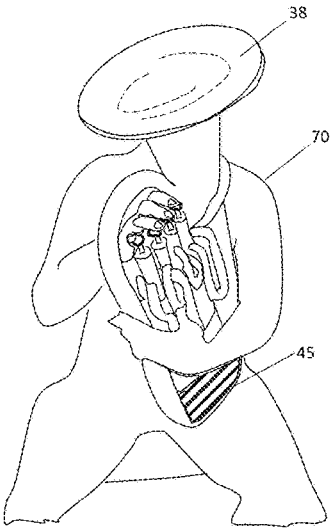
Figure 6D:
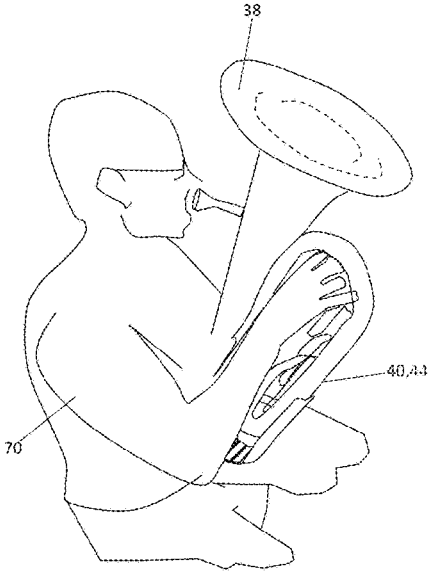
Figure 6E:
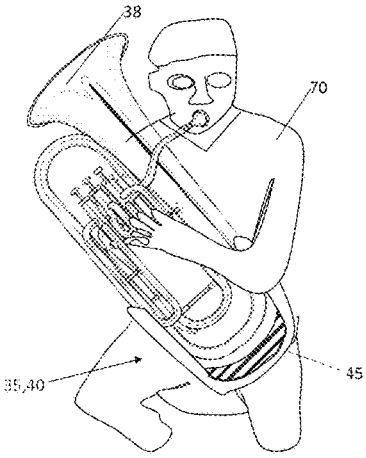

FIGS. 1A through 1C are sketches of the general euphonium extension rest device 30 for euphonium 38 and baritone 39 instruments applications. Presented in this overview are: a special euphonium extension rest device 30; a prototype 35 of Special euphonium extension rest device 30; a design sketch 37 of Special euphonium extension rest device 30; a euphonium instrument 38; an extendable wrap 40 made of durable and lightweight metal, steel, tin, aluminum, cast zinc, brass, molded plastics—reinforced and non-reinforced, and composite materials; a left- and right-side rails 44 of the wrap 40; a bottom half of a hemisphere 45 of wrap 40; a quick release band clamp 50 (like or like a radiator clamp); a threaded wing operator 51 on clamp 50; an optional external pad 55 rest; a protection cushion 60 made of foam, felt, fabric, plastic, natural or synthetic rubber or the like; a means to secure 66 such as adhesive tape, glue, contact cement, heat fusion/seal or the like securing protection cushion 60 to wrap 40; and a musician 70.

FIGS. 2A through 2E are sketches of the prototype of a special euphonium extension rest device 30 with components and features noted. Portrayed in these sketches are: an extendable wrap 40 made of durable and lightweight metal, aluminum, cast zinc, brass, molded plastics—reinforced and non-reinforced, and composite materials; a left- and right-side rails 44 of the wrap 40; a bottom half of a hemisphere 45 of wrap 40; a quick release band clamp 50 (like or like a radiator clamp); a threaded wing operator 51 on clamp 50; an optional external pad 55 rest; aperture/slot 57 in extendable wrap 40 that allows quick release double headed threaded locking fastener 52 to releasably secure wrap 40 to Euphonium instrument 38 or Baritone horn 39; and a protection cushion 60 made of foam, felt, fabric, plastic, natural or synthetic rubber or the like.

FIGS. 3A through 3D are more sketches of the protype 35 device of the special euphonium extension rest device 30 with the components and features shown from generally a top view. Demonstrated in these views are an extendable wrap 40 made of durable and lightweight metal, aluminum, cast zinc, brass, molded plastics—reinforced and non-reinforced, and composite materials; a left- and right-side rails 44 of the wrap 40; a bottom half of a hemisphere 45 of wrap 40; aperture/slot 57 in extendable wrap 40 that allows quick release double headed threaded locking fastener 52 to releasably secure wrap 40 to Euphonium instrument 38 or Baritone horn 39; and a protection cushion 60 made of foam, felt, fabric, plastic, natural or synthetic rubber or the like.

FIGS. 4A through 4I are sketches of the special euphonium extension rest device 30, 37 with features and components identified. Shown in these sketches are the following: a special euphonium extension rest device 30; a design sketch 37 of special euphonium extension rest device 30; a euphonium instrument 38; a baritone horn 39; an extendable wrap 40 made of durable and lightweight metal, aluminum, cast zinc, brass, molded plastics—reinforced and non-reinforced, and composite materials; a left- and right-side rails 44 of the wrap 40; inside surface 44A of each of the Left- and right-side rails 44 of the wrap 40; a bottom half of a hemisphere 45 of wrap 40; a quick release band clamp 50 (like or like a radiator clamp); a threaded wing operator 51 on clamp 50; a quick release double headed threaded locking fastener 52; a non-marring, friction tip 52A of quick release double headed threaded locking fastener 52; a pair of flanges 52B on boss 52C to slidably contain wrap side 44 in the aperture 57; a threaded boss 52C for fastener 52D; the fastener 52D; an optional internal band 53 at horn band 54 with quick release double headed threaded locking fastener 52; a means 53A to connect internal band 53 to inside surface of wraps 44A such as adhesive, epoxy, integral molding plastics, heat welds, ultrasonic welds, braze, weld, etc. the horn band 54 integral to horn design and build; an optional external pad 55 rest; the aperture/slot 57 in extendable wrap 40 that allows quick release double headed threaded locking fastener 52 to releasably secure wrap 40 to Euphonium instrument 38 or Baritone horn 39; a protection cushion 60 made of foam, felt, fabric, plastic, natural or synthetic rubber or the like; and a means to secure 66 such as an adhesive tape, glue, contact cement, heat fusion/seal or the like 66 securing protection cushion 60 to wrap 40. One notes with the alternative internal band 53, care is used to place it contiguous to the horn band 54 to prevent any crushing action during the placement of the wrap 40.

FIGS. 5A through 5D are sketches of the prototype 35 device with components shown attached to a euphonium 38. FIGS. 6A through 6E are sketches of a musician 70 using the special extension rest device 30, 35 to support a euphonium 38 while being played at a performance. These are described below in the Operations Section.

Figure 7A:
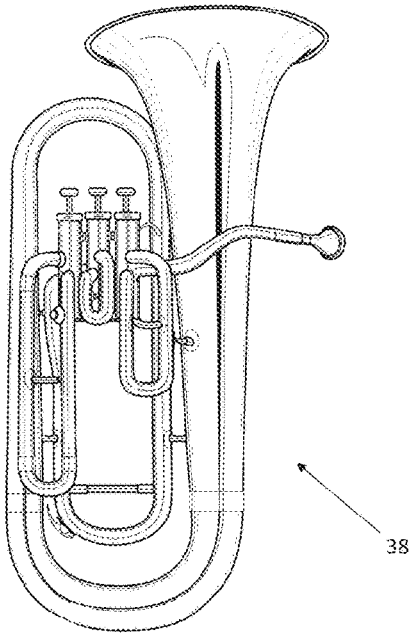
FIGS. 7A and 7B are sketches of a euphonium and a baritone horn device.
Figure 7B:
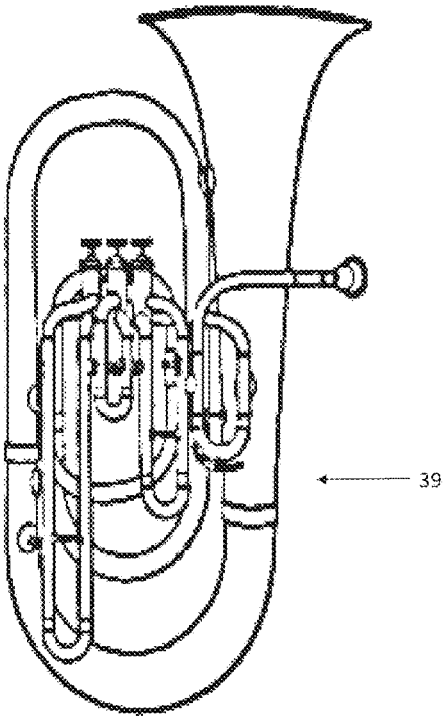
Figure 8A:
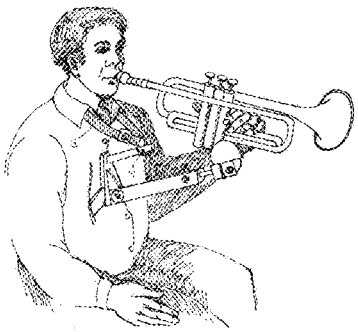
Fig. 8 A Prior Art
FIGS. 8A through 8F are sketches of prior art with related devices and mechanisms portrayed.
Figure 8B:
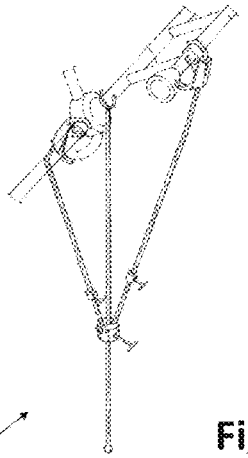
Fig. 8 B Prior Art
Figure 8C:
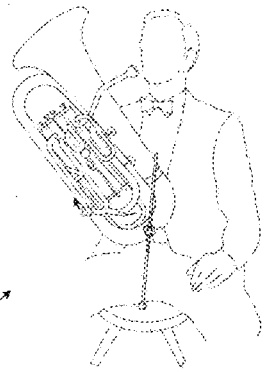
Fig. 8 C Prior Art
Figure 8D:
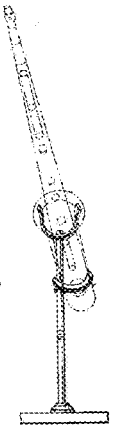
Fig. 8 D Prior Art
Figure 8E:
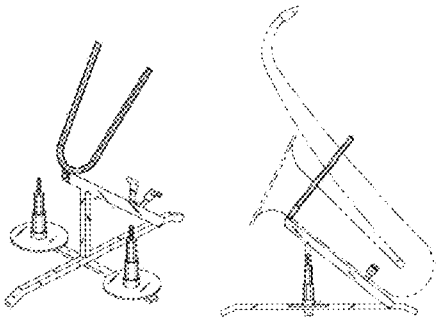
Fig. 8 E Prior Art
Figure 8F:
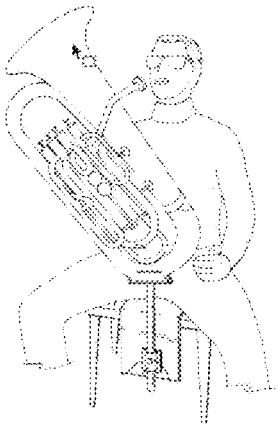
Fig. 8 F Prior Art

FIGS. 7A and 7B are sketches showing the differences and similarities of a euphonium 38 and a baritone horn 39 device. These sketches present: A Euphonium 38. The euphonium is a medium-sized, conical-bore, tenor-voiced brass instrument that is part of the tuba family. Its name comes from an ancient Greek word, translated as "well-sounding" or "sweet-voiced." The euphonium is a piston-valve instrument. The euphonium has a larger bell and bore, and its tubing is mostly conical, meaning that the diameter of the tubing becomes larger as it extends to the bell. It has a darker, more powerful sound. Euphoniums can have either three or four valves—in the case of four, three are top action, played with the fingers of the right hand and the fourth is mid-way down the right side of the instrument and is played with the left index finger. A Baritone Horn 39 A baritone has a smaller bore and bell than a euphonium, with tubing that is mostly cylindrical, meaning that the tubing is the same diameter throughout. Its sound is lighter and brighter. Baritones typically have three valves but may have four. The baritone horn is more tightly wrapped than the euphonium and has a smaller bell. This makes the instrument more compact, thus easier to carry and handle.

FIGS. 8A through 8F are sketches of prior art with related devices and mechanisms portrayed. Here former patents and applications for various supports and holding devices on other musical instruments are shown. These include: Prior Art 200 World Patent—WO 02/05259—Stabilizer for small brass instrument—Shulman—2002; Prior Art 201—U.S. Pat. No. 7,473,83—Trombone Stand—Holtfreter—2009; Prior Art 202—U.S. Pat. No. 3,811,357—Musical Instrument Support—Stewart—1974; Prior Art 203—U.S. Pat. No. 4,572,050—No Strap Saxophone Stand—Werner—1986; Prior Art 204—U.S. Pat. No. 6,220,459—Saxophone Stand—Runyon—2001; and Prior Art 205—U.S. Pat. No. 5,789,687—Musical Instrument Support—Johnson—1998. As can be observed, the special euphonium extension rest device is a unique combination and use as described herein.

The details mentioned here are exemplary and not limiting. Other specific components and manners specific to describing a special euphonium extension rest device 30 may be added as a person having ordinary skill in the field of the art of musical instruments, their supports and associated apparatuses and their uses well appreciates.

Operation of the Preferred Embodiment

The special euphonium extension rest device 30 has been described in the above embodiment. The manner of how the device operates is described below. One notes well that the description above and the operation described here must be taken together to fully illustrate the concept of the special euphonium extension rest device 30. The preferred embodiment of a Special Euphonium Extension device 30 is comprised of: (a) an extendable wrap 40 made of durable and lightweight material comprising a left-hand and right-hand curved side rails 44 and a bottom half of a hemisphere 45; (b) a protection cushion 60 contiguous to the left-hand and right-hand curved side rails; (c) a means to secure 66 the protection cushion 60 to each of the left-hand and right-hand curved side rails; and (d) a pair of quick release band clamps 50 encircling a set of euphonium 38 side tubing to the left-hand and right-hand curved side rails 44 of the extension rest device wherein the pair of quick release clamps 50 releasably secure the extension rest device to the side tubing of the euphonium and permit the extension rest bottom 45 and optional pad rest 55 device to slidably extend to support and slidably retract to store the device along the side tubing of the euphonium.

The special euphonium extension rest device 30 operates as follows: PRE-ASSEMBLY: The protection cushion 60 [made of foam, felt, fabric, plastic, natural or synthetic rubber or the like] is secured to the left-hand and right-hand side rails 44 of the wrap 40 [made of durable and lightweight metal, aluminum, cast zinc, brass, molded plastics—reinforced and non-reinforced {polycarbonate, nylon, urethane, Polyethylene Terephthalate (PET or PETE or Polyester), High-Density Polyethylene (HDPE), Polyvinyl Chloride (PVC), Low-Density Polyethylene (LDPE), Polypropylene (PP), Polystyrene (PS), and Acrylonitrile butadiene styrene}, and composite materials] with the means to secure 66 such as an adhesive tape, glue, contact cement, heat fusion/seal. The bottom hemisphere 45 is secured/connected (releasably or not) between the ends of the left and right-hand side rails 44. This can be a three-piece assembly fastened, welded, fused together (releasably or not) or may be an integrally molded plastic, composite material, etc.), integrally stamped sheet metal, or integrally formed casting.

ASSEMBLY to EUPHONIUM: A pair of band clamps 50 encircle the side tubing of the euphonium 39 and the side rails 44 of the device 30. The threaded wings 51 are finger-tightened t0 the euphonium 39. The bottom rail 45 is extended or retracted to a desired position. The threaded wings 51 are further tightened to secure the device 40 as a rigid assembly. To remove or retract the bottom 45, the process is performed in reverse order. The alternative quick release double headed threaded locking fastener 52 with the optional non-marring, friction tip 52A works in a similar manner with the flanges 52B on boss 52C to slidably contain wrap side 44 aperture 57; threaded boss 52C for fastener 52D; fastener 52D; internal band 53 at horn band 54 with quick release double headed threaded locking fastener 52 to the horn band 54 integral to horn design; and aperture/slot 57 in extendable wrap 40 that allows quick release double headed threaded locking fastener to releasably secure wrap 40 to Euphonium instrument 38 or Baritone horn 39.

FIGS. 5A through 5D are sketches of the prototype 35 device with components shown attached to a euphonium 38. a special euphonium extension rest device 30; a prototype 35 of Special euphonium extension rest device 30; a euphonium instrument 38; a baritone horn 39; an extendable wrap 40 made of durable and lightweight metal, aluminum, cast zinc, brass, molded plastics—reinforced and non-reinforced, and composite materials; a left- and right-side rails 44 of the wrap 40; a bottom half of a hemisphere 45 of wrap 40; a quick release band clamp 50 (like or like a radiator clamp); a threaded wing operator 51 on clamp 50; a protection cushion 60 made of foam, felt, fabric, plastic, natural or synthetic rubber or the like; and an adhesive tape, glue, contact cement, heat fusion/seal or the like securing protection cushion 60 to wrap 40.

FIGS. 6A through 6E are sketches of a musician 70 using the special extension device 30, 35 to support a euphonium 38 while being played at a performance. a special euphonium extension rest device 30; a prototype 35 of Special euphonium extension rest device 30; a euphonium instrument 38; an extendable wrap 40 made of durable and lightweight metal, aluminum, cast zinc, brass, molded plastics—reinforced and non-reinforced, and composite materials; La left- and right-side rails 44 of the wrap 40; a bottom half of a hemisphere 45 of wrap 40; a quick release band clamp 50 (like or like a radiator clamp); a threaded wing operator 51 on clamp 50; a protection cushion 60 made of foam, felt, fabric, plastic, natural or synthetic rubber or the like; a means to secure 66 such as an adhesive tape, glue, contact cement, heat fusion/seal or the like securing protection cushion 60 to wrap 40; and a musician 70.

Many musical instruments are anticipated for the special euphonium extension rest device 30 or a very close facsimile thereof. Some examples, and not limitations, are shown in the following Table C.

| ITEM | DESCRIPTION |
|---|---|
| 1 | Euphonium 38 |
| 2 | Baritone Horn 39 |
| 3 | Small Tuba & Sousaphone |
| 4 | Alto/Tenor Horn |
| 5 | Flugelhorn |
| 6 | Cornet |

With this description it is to be understood that the special euphonium extension rest device 30 is not to be limited to only the disclosed embodiment of product. The features of the special euphonium extension rest device 30 are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and, in its operation, can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiments of this invention. It is also contemplated those various combinations or sub-combinations of the specific features and aspects of the embodiments may be made and still fall within the scope of the inventions. Various features and aspects of the disclosed embodiments can be combined with or substituted for one another to form varying modes of the disclosed inventions. Thus, it is intended that the scope of at least some of the present inventions herein disclosed should not be limited by the disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any embodiment, feature, or combination of features shown herein. This is true even if only a single embodiment of the feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed considering the number of recited significant digits and by applying ordinary rounding techniques.

The present invention contemplates modifications as would occur to those skilled in the art. While the disclosure has been illustrated and described in detail in the figures and the foregoing description, the same is to be considered as illustrative and not restrictive in character, it being understood that only selected embodiments have been shown and described and that all changes, modifications and equivalents that come within the spirit of the disclosures described heretofore and or/defined by the following claims are desired to be protected.

What is claimed is:

1. A special extension rest device (30) for a musical horn (38), the extension rest device being comprised of: (a) an extendable wrap (40) made of durable and lightweight material comprising a left-hand and right-hand curved side rail (44) and a bottom half of a hemisphere (45);

(b) a protection cushion (60) contiguous to the left-hand and right-hand curved side rails;

(c) a means to secure (66) the protection cushion (60) to each of the left-hand and right-hand curved side rails;

(d) a pair of quick release band clamps (50) encircling extendable wrap and the musical horn at the left-hand and right-hand curved side rails of the extension rest device; and (e) a means (51) to tighten and to releasably secure each of the quick release band clamps (50) encircling the extendable wrap and the musical horn wherein the pair of quick release clamps releasably secure the extension rest device to the side tubing of the musical horn and permit the extension rest device to slidably extend to support and then to slidably retract to enable storage of the extendable wrap along a side of the musical horn.

2. The special extension rest device (30) for a musical horn (38), in claim 1 further comprised of an external pad (55) rest.

3. The special extension rest device (30) for a musical horn (38) in claim 1 wherein the durable and lightweight material comprising a left-hand and right-hand curved side rail (44) and a bottom half of a hemisphere (45) is selected from a group consisting of metal, molded plastics, and composite materials.

4. The special extension rest device (30) for a musical horn (38) in claim 3 wherein the metal is selected from the group consisting of steel, tin, aluminum, cast zinc, and brass.

5. The special extension rest device (30) for a musical horn (38) in claim 3 wherein the molded plastics polycarbonate, nylon, urethane, Polyethylene Terephthalate (PET), High-Density Polyethylene (HDPE), Polyvinyl Chloride (PVC), Low-Density Polyethylene (LDPE), Polypropylene (PP), Polystyrene (PS), and Acrylonitrile butadiene styrene (ABS).

6. The special extension rest device (30) for a musical horn (38) in claim 1 wherein the material for the protection cushion (60) is selected from the group consisting of foam, felt, fabric, plastic, natural rubber and synthetic rubber.

7. The special extension rest device (30) for a musical horn (38) in claim 1 wherein the means to secure (66) the protection cushion (60) to each of the left-hand and right-hand curved side rails (44) is selected from the group consisting of adhesive tape, glue, contact cement, and heat fusion/seal.

8. The special extension rest device (30) for a musical horn (38) in claim 1 wherein the means (51) to tighten and to releasably secure each of the quick release band clamps (50) encircling the extendable wrap and the musical horn is a threaded wing fastener (51).

9. The special extension rest device (30) for a musical horn (38) in claim 1 wherein the musical horn is selected from the group consisting of Euphonium, Baritone Horn, Small Tuba & Sousaphone, Alto/Tenor Horn, Flugelhorn, and a Cornet.

10. A special extension rest device (30) for a musical horn (38), the extension rest device being comprised of: (a) an extendable wrap (40) made of durable and lightweight material comprising a left-hand and right-hand curved side (44) rail each with a slot/aperture (57) and a bottom half of a hemisphere (45);

(b) a protection cushion (60) contiguous to the left-hand and right-hand curved side rails;

(c) a means to secure (66) the protection cushion (60) to each of the left-hand and right-hand curved side rails;

(d) a pair of quick release internal band bands (53) attached by a means (53A) for securing to an inside surface (44A) of each of the left-hand and right-hand curved side rails and encircling the musical horn at a horn band (54); and (e) a means (52) to tighten and to releasably secure each of the quick release internal band (53) encircling the extendable wrap and the musical horn wherein the pair of internal release bands releasably secure the extension rest device to the musical horn and permit the extension rest device to slidably extend to support and then to slidably retract to enable storage of the extendable wrap along a side of the musical horn.

11. The special extension rest device (30) for a musical horn (38), in claim 10 further comprised of an external pad (55) rest.

12. The special extension rest device (30) for a musical horn (38) in claim 10 wherein the durable and lightweight material comprising a left-hand and right-hand curved side rail (44) and a bottom half of a hemisphere (45) is selected from a group consisting of metal, molded plastics, and composite materials.

13. The special extension rest device (30) for a musical horn (38) in claim 12 wherein the metal is selected from the group consisting of steel, tin, aluminum, cast zinc, and brass.

14. The special extension rest device (30) for a musical horn (38) in claim 12 wherein the molded plastics polycarbonate, nylon, urethane, Polyethylene Terephthalate (PET), High-Density Polyethylene (HDPE), Polyvinyl Chloride (PVC), Low-Density Polyethylene (LDPE), Polypropylene (PP), Polystyrene (PS), and Acrylonitrile butadiene styrene (ABS).

15. The special extension rest device (30) for a musical horn (38) in claim 10 wherein the material for the protection cushion (60) is selected from the group consisting of foam, felt, fabric, plastic, natural rubber and synthetic rubber.

16. The special extension rest device (30) for a musical horn (38) in claim 10 wherein the means to secure (66) the protection cushion (60) to each of the left-hand and right-hand curved side rails (44) is selected from the group consisting of adhesive tape, glue, contact cement, and heat fusion/seal.

17. The special extension rest device (30) for a musical horn (38) in claim 10 wherein the means (51) to tighten and to releasably secure each of the internal band (53) encircling the musical horn is a quick release double headed threaded locking fastener (52).

18. The special extension rest device (30) for a musical horn (38) in claim 17 wherein the quick release double headed threaded locking fastener (52) is comprised of a pair of flanges (52B) on boss (52C) to slidably contain the wrap side (44) in the slot/aperture (57) to the horn (38), and a threaded boss (52C) for a fastener 52D.

19. The special extension rest device (30) for a musical horn (38) in claim 10 wherein the wrap (44) is further comprised of an inside surface (44A) of each of the Left- and right-side rails (44) of the wrap 40 and a means (53A) to connect internal band (53) to inside surface (44A).

20. The special extension rest device (30) for a musical horn (38) in claim 19 wherein the means (53A) to connect internal band (53) to inside surface (44A) is selected from the group consisting of adhesive, epoxy, integral molding plastics, heat welds, ultrasonic welds, brazes, and metal welds.

* * * * *